US008567867B2

(12) United States Patent
Arnold, IV et al.

(10) Patent No.: US 8,567,867 B2
(45) Date of Patent: Oct. 29, 2013

(54) CHILD SEAT WITH ADJUSTABLE BACK

(75) Inventors: John (Jason) C. Arnold, IV, Philadelphia, PA (US); Dennis R. Stauffer, Birdsboro, PA (US)

(73) Assignee: Graco Children's Products Inc., Atlanta, GA (US)

( * ) Notice: Subject to any disclaimer, the term of this patent is extended or adjusted under 35 U.S.C. 154(b) by 160 days.

(21) Appl. No.: 12/995,347

(22) PCT Filed: May 30, 2009

(86) PCT No.: PCT/US2009/045759

§ 371 (c)(1), (2), (4) Date: Apr. 1, 2011

(87) PCT Pub. No.: WO2009/158134

PCT Pub. Date: Dec. 30, 2009

(65) Prior Publication Data

US 2011/0181084 A1 Jul. 28, 2011

Related U.S. Application Data

(60) Provisional application No. 61/057,718, filed on May 30, 2008.

(51) Int. Cl.

| | |
|---|---|
| ***B60N 2/28*** | (2006.01) |
| ***A47D 1/10*** | (2006.01) |
| ***A47C 7/02*** | (2006.01) |

(52) U.S. Cl.

USPC ..... 297/383; 297/250.1; 297/256.1; 297/256.16; 297/440.15; 297/440.16; 297/440.2; 297/440.21

(58) Field of Classification Search

USPC ..... 297/383, 440.16, 440.21, 250.1, 256.1, 297/256.16, 440.15, 440.2

See application file for complete search history.

(56) References Cited

U.S. PATENT DOCUMENTS 390,909 A * 10/1888 Seip ..... 297/440.2 X
1,465,291 A 8/1923 Walker (Continued)

FOREIGN PATENT DOCUMENTS

| | | |
|---|---|---|
| DE | 86 09 270.7 | 7/1986 |
| DE | 92 16 287.8 | 5/1993 |

(Continued)

OTHER PUBLICATIONS

International Search Report and Written Opinion issued in related PCT Application No. PCT/US2009/045759.

*Primary Examiner* — Rodney B White

(74) *Attorney, Agent, or Firm* — Lempia Summerfield Katz LLC

(57) ABSTRACT

A child seat has a seat base with a seating surface, a front edge, and a back end. A back support surface of the child seat is generally inclined relative to the seating surface. A seat bight is formed at the juncture between the seating surface and the back support surface. The seat bight is adjustable between a first bight position spaced a first distance from the front edge of the seat base and a second bight position spaced a second distance from the front edge of the seat base. The second distance is less than the first distance. A seat back insert can be provided that is attachable to the seat base in one or more insert positions defining one or more of the bight positions. The insert can create the back support surface at one or more position relative to the front edge. The seat base can also have a back wall creating the back support surface further from the front edge when the insert is removed.

20 Claims, 15 Drawing Sheets

(56) References Cited

U.S. PATENT DOCUMENTS

| | | | | | |
|---|---|---|---|---|---|
| 2,461,123 | A | * | 2/1949 | Miller | 297/383 X |
| 2,466,350 | A | | 4/1949 | Anderson | |
| 4,032,189 | A | * | 6/1977 | Benavente et al. | 297/383 X |
| 4,466,660 | A | * | 8/1984 | Mabie | 297/383 X |
| 4,570,998 | A | * | 2/1986 | Hughes | 297/353 |
| 4,854,638 | A | | 8/1989 | Marcus et al. | |
| 4,944,556 | A | | 7/1990 | Griesbaum et al. | |
| 5,067,187 | A | * | 11/1991 | Messina | 297/383 X |
| 5,127,120 | A | | 7/1992 | Mason | |
| 5,344,216 | A | * | 9/1994 | Suominen | 297/383 |
| 5,372,405 | A | * | 12/1994 | Cash et al. | 297/383 |
| 5,409,307 | A | * | 4/1995 | Forsythe | 312/194 |
| 5,441,330 | A | * | 8/1995 | Rojas | 297/383 |
| 5,544,937 | A | * | 8/1996 | Hanagan | 297/215.12 |
| 5,599,066 | A | * | 2/1997 | Chih | 297/383 |
| 6,921,135 | B2 | * | 7/2005 | Ellis et al. | 297/383 X |
| 7,073,854 | B2 | * | 7/2006 | Tseng | 297/353 X |
| 7,222,920 | B1 | * | 5/2007 | Washington | 297/383 |
| 7,357,453 | B2 | * | 4/2008 | Wu | 297/383 X |
| 7,422,286 | B2 | * | 9/2008 | Wu | 297/383 X |
| 7,931,339 | B1 | * | 4/2011 | Stocker et al. | 297/383 |

FOREIGN PATENT DOCUMENTS

| | | |
|---|---|---|
| GB | 932 781 | 7/1963 |
| GB | 2 375 956 | 12/2002 |
| WO | WO 95/05952 | 3/1995 |
| WO | WO 2004/086916 | 10/2004 |

* cited by examiner

CHILD SEAT WITH ADJUSTABLE BACK

RELATED APPLICATION DATA

This patent is related to and claims priority benefit of U.S. provisional patent application Ser. No. 61/057,718 filed on May 30, 2008, the entirety of which is incorporated herein by reference.

BACKGROUND

1. Field of the Disclosure

The present invention is generally directed to booster seats and the like for children, and more particularly to a child seat with a positionally adjustable seat back.

2. Description of Related Art

A typical booster seat has a seating surface with a front edge and a seat back spaced a distance rearward of the front edge. Often, the seating surface is also surrounded on either side by a raised rim or side wall, which is a continuation of the seat back. The raised rim wall on the sides of the seating surface and the seat back are sometimes of the same height and typically not high enough to provide sufficient back support for young occupants of the seat occupant. Very small and young seat occupants typically might need some substantial back support while seated in the seat. Some boosters provide a seat back with a height that is sufficient to provide support for such an occupant. On either type of booster seat, the distance from the front edge of the seating surface to the seat back is fixed.

The typical booster seat is thus configured to accommodate a limited size range of children. It has become apparent to the inventors that the typical booster seat is too big for smaller and/or younger children to be able to actually use it. The height of the seat back on many booster seats is insufficient to provide support for the smaller seat occupant. However, a higher seat back may reduce the comfort of the seat for larger children, or can even become a hindrance to a seat occupant of a particularly large size. The distance between the front edge of the seating surface and the seat back can also be too long for the smaller child so that either they cannot even reach or touch the seat back, or their knee joints cannot reach the front edge of the seating surface with their back against the seat back.

A new government booster seat standard also requires the use of a harness for a child under a certain age on boosters, highchairs, youth chairs and the like. A highchair is sometimes designed so that it can be reconfigured from a highchair configuration (for infants and toddlers) to a youth chair configuration (for older children). Some highchairs are configured with a harness to assist in restraining the occupant of the highchair in the seat. The harness may not be removable from the highchair and, thus, the highchair might not be particularly comfortable for larger children that may not utilize, or are not required to utilize, the harness. On some highchairs, the harnesses can be removed, but this is rather cumbersome and reinstallation of the harness if needed can also be tedious and difficult. Some boosters are also configured with a harness. The harness may also be removable from the booster seat. However, harness removal is still difficult and the size restrictions of these types of highchairs and booster seats present the same problems noted above with respect to a typical booster seat.

SUMMARY

A child seat according to one example of the disclosed invention has a seat base with an upward facing seating surface, a front edge, and a back end opposite the front edge. A back support surface is generally upstanding and is inclined relative to the seating surface. A seat bight is formed at the juncture between the seating surface and the back support surface. The seat bight is adjustable between a first bight position spaced a first distance from the front edge of the seat base and a second bight position spaced a second distance from the front edge of the seat base, the second distance being less than the first distance. The adjustable seat bight position allows the child seat to be adjusted to accommodate small children of different size and/or to grow with a child.

In one example, a child seat can also have a seat back insert that is removable from and replaceable on the seat base to adjust the distance of the seat bight relative to the front edge. The seat back insert can define the back support surface at least for the second bight position.

In on example, a child seat can have a seat back insert that is replaceable on the seat base in a first insert position and a second insert position so as to define the back support surface for the first bight position in the first insert position and to define the back support surface for the second bight position in the second insert position.

In one example, a child seat can also have a back wall extending up from the seat base near the back end. The back wall can have a wall surface facing the seating surface and the front edge.

In one example, a child seat can also have a seat back insert that is removable from and replaceable on the seat base. The seat back insert can define the back support surface in the second bight position and a wall surface of a back wall of the seat base can define the first bight position.

In one example, a child seat can have a seat back insert that is removable from and replaceable on the seat base in a first insert position and a second insert position. The seat back insert in the first insert position can define the back support surface in the first bight position and in the second insert position can define the back support surface in the second bight position. A wall surface of a back wall on the seat base can define the back support surface in a third bight position when the seat back insert is removed.

In one example, a child seat can have a first pair of channels formed one each on opposite sides of the seat base. A seat back insert can be configured to removably attach at the first pair of channels to the seat base at a first insert position defining the first bight position. The seat back insert can have opposed side edges and a surface defining the back support surface in the first insert position.

In one example, a child seat can have a second pair of channels formed one each on opposite sides of the seat base and spaced from a first pair of channels. A seat back insert can be removably attached at the second pair of channels to the seat base at a second insert position and define a second bight position and a back support surface in the second insert position.

In one example, a child seat can have a retractable catch projecting from each opposed side edge of a seat back insert. A catch receiver can be provided in each of a first pair of channels and configured to receive a respective one of the catches when the seat back insert is attached to the seat base.

In one example, a child seat can have a release handle on a seat back insert actuable to retract the catches from catch receivers on the seat base to remove the seat back insert from the seat base.

In one example, a child seat can have a pair of opposed side walls extending up from the seat base, one on each opposed side of the seating surface. Each of the pair of side walls can have a top end and a side wall surface on an inner side facing the seating surface. A first pair of channels can be aligned with and opposite one another across the seat base and each channel of the pair can be open into the top end and be recessed into the side wall surface of a corresponding one of the pair of side walls. A seat back insert can be configured to slide downwardly into the first pair of channels to attach the seat back insert to the seat base at a first insert position defining the first bight position.

In one example, the seat base of a child seat is carried on a highchair frame and is configured so that a highchair seat can be mounted and supported on the seat base.

In one example, the seat base of a child seat is a booster seat configured to rest on a seat of a chair. In one example, the booster seat has attachment devices for securing the booster seat to seat of a chair.

In one example, a child seat of the invention has a seat base with a seating surface, a front edge, opposed sides, and a back end opposite the front edge. A seat back insert is removably attachable to the seat base above the seating surface. The seat back insert has opposed side edges and a back support surface facing toward the front edge of the seat base. The seat back insert is attachable to the seat base in at least a first insert position with the back support surface spaced a first distance from the front edge and a second insert position with the back support surface spaced a second distance from the front edge less than the first distance.

In one example, a child seat has a side wall on each opposed side and extending up from the seat base. Each side wall has a top end and a side wall surface on an inner side facing the seating surface. A first pair of channels is aligned with and opposite one another across the seat base, one channel being formed in each of the side walls. The seat back insert is slid into the first pair of channels when attached to the seat base at the first insert position. A second pair of channels is spaced from the first pair of channels in the side walls and is aligned with and opposite one another across the seat base. The seat back insert is slid into the second pair of channels when attached to the seat base at the second insert position.

In one example, a child seat has first and second pairs of channels in the seat base and each channel is open into a top end and recessed into a side wall surface of a respective side wall.

In one example, a child seat has a retractable catch projecting from each opposed side edge of a seat back insert. A first receiver is provided on each of the opposed sides of the seat base and configured to receive a respective one of the catches when the seat back insert is attached at the first insert position to the seat base. A second receiver is provided on each of the opposed sides of the seat base and configured to receive a respective one of the catches when the seat back insert is attached at the second insert position to the seat base.

In one example, a child seat has a release actuator on a seat back insert arranged to retract catches one the seat back insert when actuated.

In one example, a child seat of the invention has a seat base with a seating surface, a front edge, and a back end opposite the front edge. A back wall extends up from the seat base near the back end and has a wall surface facing the seating surface and the front edge. A seat back insert is removably attachable to the seat base above the seating surface. The seat back insert has a back support surface that is positioned forward of and closer to the front edge than the wall surface of the back wall when attached to the seat base. When the seat back insert is removed from the seat base, the wall surface of the back wall is exposed to perform as an alternate back support surface.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

A child seat is disclosed herein that solves or improves upon one or more of the above noted and/or other problems and disadvantages with prior art child seats, booster seats, youth chair seats, and the like. The disclosed child seat has a back support surface that is adjustable in position relative to the front edge of the seating surface of the seat base. In one example, a seat back insert is provided that can be positionally adjustable on the seat base of the child seat, removable from the seat base, or both. In one example, the seat back insert is removable from the sat base and exposes a fixed back wall of the seat base. The back wall is positioned further rearward from a front edge of the seat base or seating surface than the seat back insert when installed. The seat back insert, when installed on the seat base, is positioned further forward so as to reduce to distance between the back support surface and the front edge of the seating surface or seat base. Thus, the child seat can both accommodate children of different size and accommodate a growing child for a longer period of time.

In another example, a child seat can have a seat back insert that is removable from the seat base and that can be installed on the seat base in more than one position. In another example, the seat base of such a child seat can also include a back wall so that the child seat is adjustable to provide three or more different back support surface positions. In one example, the disclosed child seat can be mounted directly on the seat of a chair. In another example, the child seat has a seat base supported on a highchair frame. In one example, the child seat can include a seat back insert with a harness assembly carried by the insert so that when the insert is installed on a seat base, the harness is ready for use to secure a child to the child's seat. In such a configuration, when the seat back insert is removed from the seat base, the harness is also removed exposing a conventional booster seat or youth chair without a harness.

Figure 1:
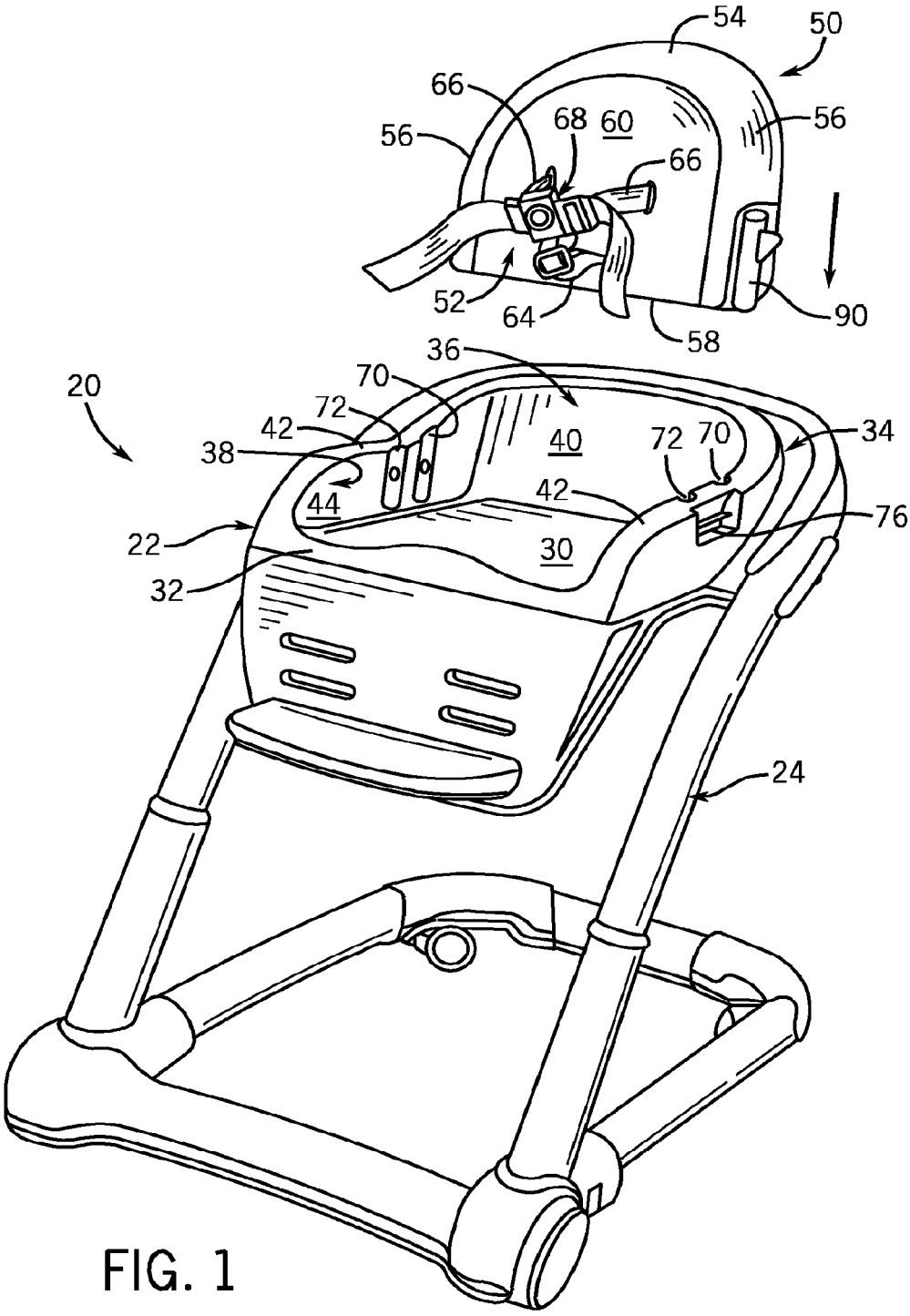
FIG. 1 shows one example of a child seat constructed in accordance with the teachings of the present invention.

Turning now to the drawings, FIG. 1 shows a partially exploded view of one example of a child seat 20 constructed in accordance with the teachings of the present invention. In this example, the child seat 20 has a seat base 22 that is mounted to and supported in an elevated position on a highchair frame 24. The seat base 22 generally has an upward facing seating surface 30, a front edge 32, and a back end 34 positioned opposite the front edge. In this example, the seat base 22 also has a back wall 36 and a pair of opposed side walls 38 positioned at the back and sides, respectively, of the seating surface 34. The back wall 36 has a wall surface 40 that is generally upstanding and inclined relative to the seating surface of the base. The pair of opposed side walls 38 also extend up from the seat base, and in this example are integral with the back wall to form a continuous rim wall around the seating surface 34, other than the front edge 32. In this example, each of the side walls 38 has a top end 42 and a side wall surface 44 on an inner side that faces the seating surface 30. As will become evident to those having ordinary skill in the art upon reading this disclosure, the back wall 36 and side walls 38 could be eliminated from the seat base 22 within the spirit and scope of the present invention. In this example, the back wall and side walls can be integrally molded as a contiguous part of a plastic seat base 22.

In this example, the child seat 20 also has a seat back insert 50 that is removable from and replaceable on the seat base 22. The seat back insert 50 is shown in exploded view in FIG. 1. In one example, the seat back insert 50 can include a harness system 52 coupled to the insert. When the insert 50 is installed on the seat base, the harness system 52 is also installed, and when the insert is removed from the seat base, the harness system is also removed. The seat back insert 50 has a top 54, a pair of opposed side edges 56, a bottom 58, a front surface defining a back support surface 60, and a rear side 62 opposite the back support surface. Both the seat back insert 50 and the harness system 52 can vary in configuration and construction from the example shown and described herein. In this example, the harness system 52 has a crotch belt 64 extending forward from the back support surface 60 near the bottom 58 of the insert. The harness system 52 also has a pair of lap belt segments 66 that extend forward from the back support surface 60 and that are spaced apart from one another near the side edges 56 of the insert. The crotch belt 64 and the lap belt segments 66 can be detachably joined to one another at a buckle assembly 68 as in known in the art.

In the disclosed example, a plurality of channels is formed in the side walls 38 on the seat base 22. A first pair of the channels 70 is formed, one in the side wall surface 44 on each of the side walls 38. A second pair of the channels 72 is also formed, one in the side wall surface 44 of each side wall 38. In this example, the second channel 72 on each side wall 38 is spaced forward from the first channel 70. Only one channel 70 and 72 of the first and second pairs of the channels is shown in FIG. 1. Each of the channels 70 and 72 is generally vertically oriented, recessed into the side wall surface 44, and open into the top end 42 on each side wall 38.

Figure 2A:
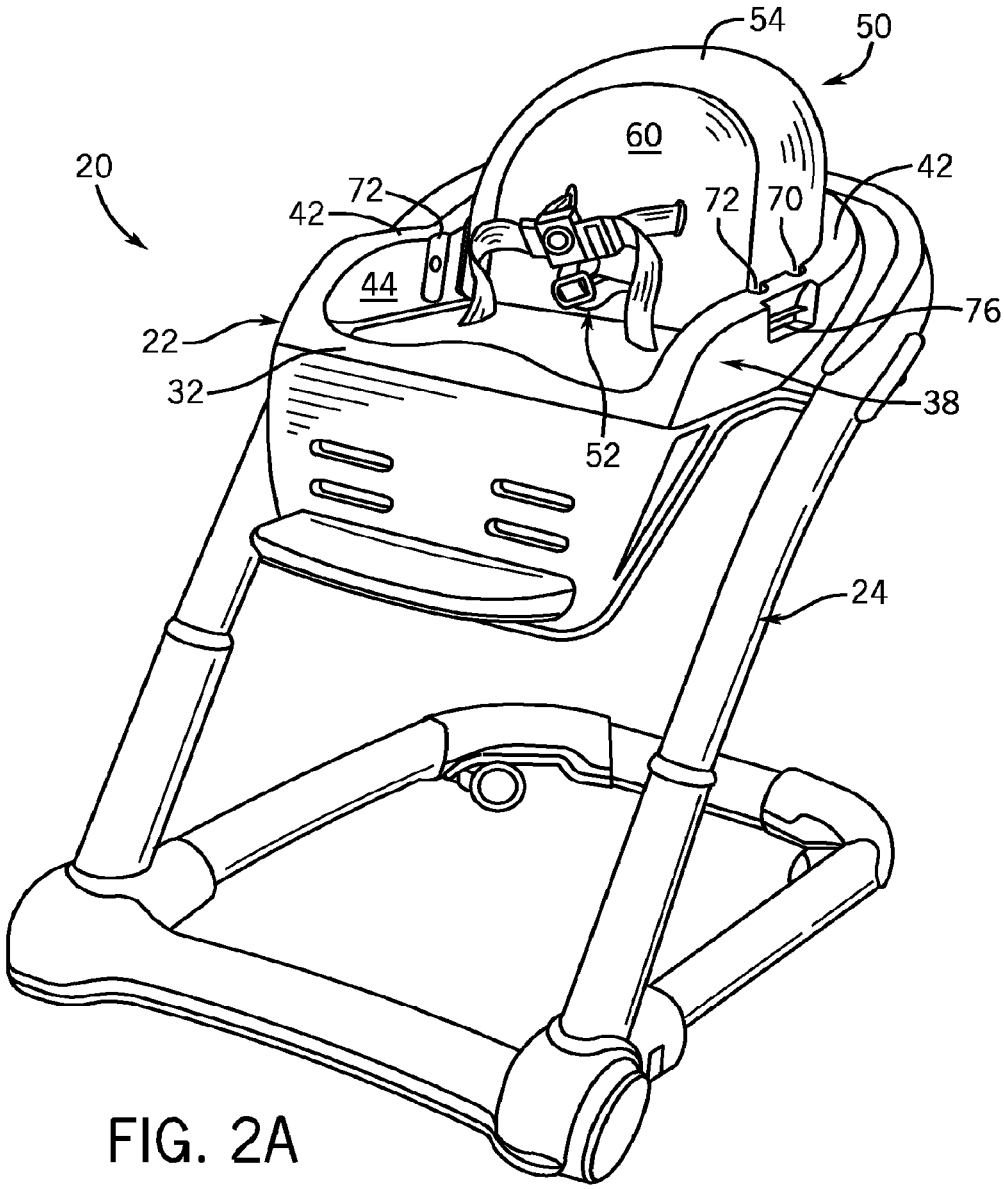
FIG. 2A shows the child seat in FIG. 1 with a seat back insert installed in a first insert position on the child seat.
Figure 2B:
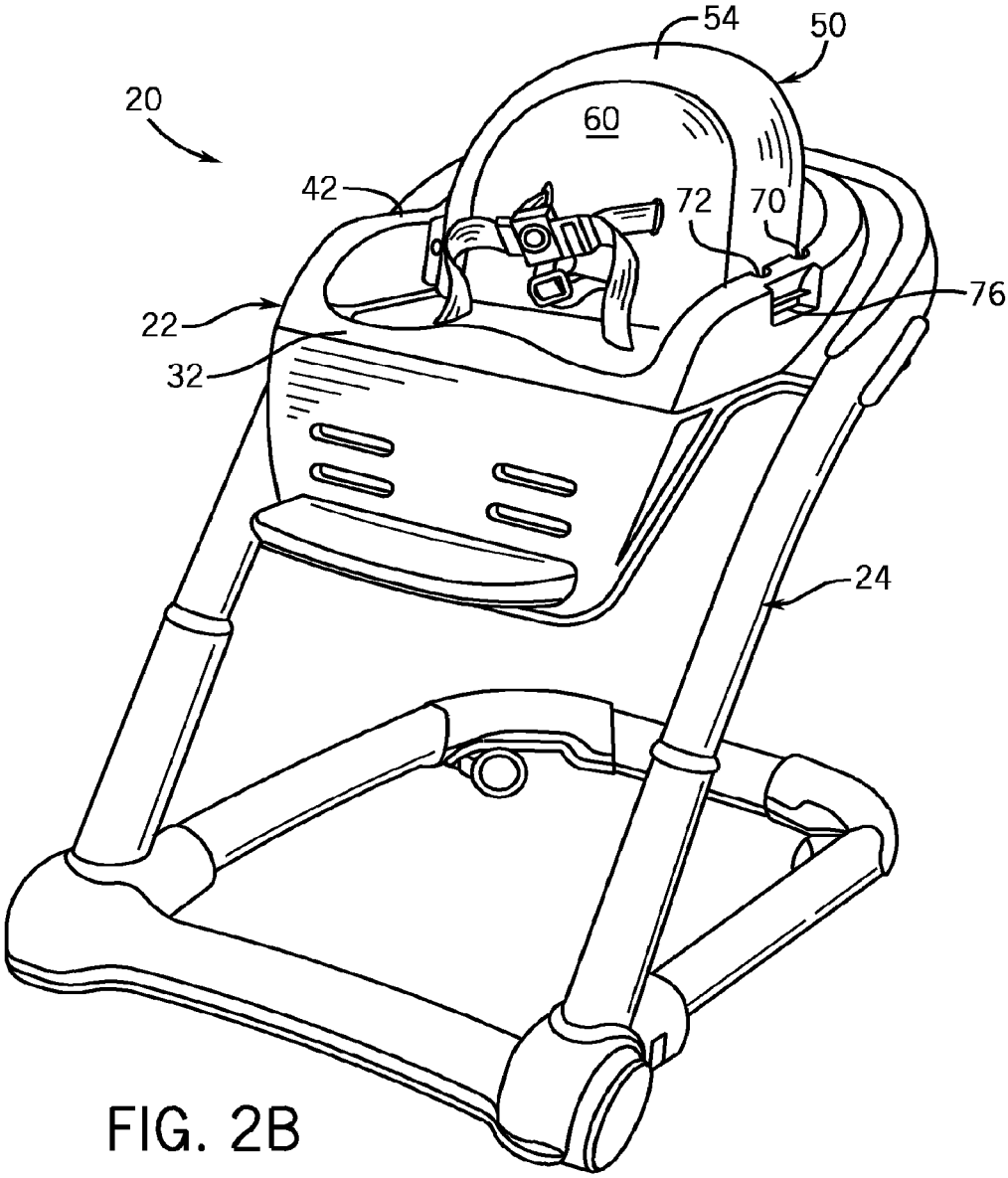
FIG. 2B shows the child seat in FIG. 1 with the seat back insert installed in a second insert position on the child seat.

As depicted in FIGS. 2A and 2B, the channels 70 and 72 define insert positions for attaching the seat back insert 50 to the seat base 22. The first pair of channels 70 defines a first insert position on the seat base 22 and the second pair of channels 72 defines a second insert position on the seat base. In this example, the second insert position of the channels 72 locates the seat back insert closer to the front edge 32 than does the first insert position of channels 70. Thus, depending upon which pair of the channels is selected by a user, the seat back insert 50 can be installed at a user selected position on the seat base relative to the front edge 32. The positioning of the back support surface 60 can thus be adjusted by a user to accommodate the size of their child.

FIG. 2A shows the seat back insert 50 installed in the first pair of channels 70 on the seat base 22. This places the seat back inset 50 at the first insert position spaced a first distance from the front edge 32 of the seating surface 30 on the seat base 22. A seat bight is defined at the juncture between the seating surface 30 on the sat base 22 and the back support surface 60 at the bottom 58 of the seat back insert 50. With the insert in the first insert position of the first pair of channels 70, a first seat bight position is defined at the first distance from the front edge 32 in this example.

FIG. 2B shows the seat back insert 50 installed in the second pair of channels 72 on the seat base 22. This places the seat back insert 50 at the second insert position spaced a second distance from the front edge 32 of the seating surface. Likewise, a second bight position is defined at the second distance with the seat back insert 50 installed or attached at the second pair of channels 72. In this example, the second distance is less than the first distance, which results in the back support surface 60 of the seat back insert 50 being closer to the front edge 32 in the second insert position than in the first insert position. Adjusting the seat back position from the first to the second insert position shortens the length of the seating surface 30 available to a seat occupant and brings the back support surface closer to the front edge 32. In this example, the seat back insert 50, when attached to the seat base 22, defines the position of the back support surface 60 of the child seat 20.

One additional, adjusted seat back position is possible in this example. One can entirely remove the seat back insert 50 from the seat base 22 as represented in FIG. 1. In such an instance, the back wall surface 40 is then exposed and can define the back support surface of the child seat. Similarly, the juncture between the lower end of the back wall 36 and the back end of the seating surface 30 can define a third bight position spaced a third distance from the front edge 32 of the seating surface 30. As a result of the construction of the child seat 20 in this example, the child seat can be reconfigured to three optional, different seat back positions or back support surface positions. The back support surface 60 in two of the optional positions is defined by the seat back insert 50. The back support surface in the third optional position is defined by the back wall surface 40 when the insert is removed.

As will be evident to those having ordinary skill in the art, more than two pair of channels could be provided on the seat base in order to add optional adjustment positions for the seat back location on the child seat. In another alternate example, only a single pair of the channels 70 or 72 could be provided on the seat base 22 to create only a single seat back insert attachment location or position. Thus, the child seat 20 in such an alternate example could be configured so that the seat back insert 50 defines only a single back support surface location or position. The back wall surface 40 would then define a second back support surface position or location. In such an example, the child seat would permit only two adjusted seat back positions instead of the three position capability of the child seat 20. In still another alternate example, the back wall 36 could be eliminated and the seat base could be constructed to provide two or more attachment locations for mounting the seat back insert. In such an example, each seat back position would be defined by the seat back insert.

Figure 3:
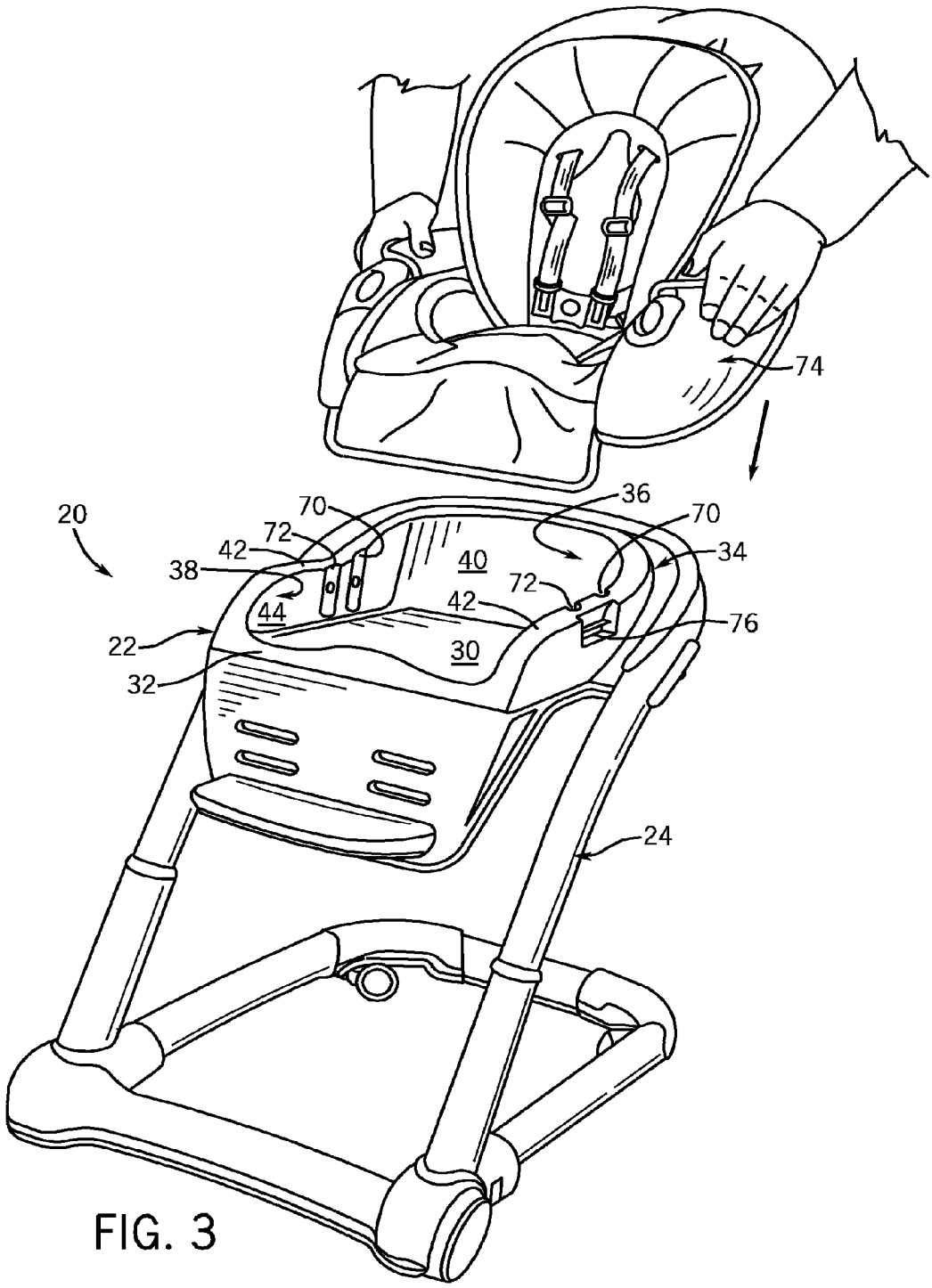
FIG. 3 shows an alternate configuration of the child seat in FIG. 1 with a highchair seat being inserted on the seat base of the child seat.

The seat base 22 in this illustrated example of FIGS. 1, 2A, and 2B can be provided as a semi-permanent attachment to the highchair frame 24 such that the base is not intended to be removed from the frame. In such an example, the seat base 22 and frame 24 can also be configured to accept another type of seat mounted thereon. For example, a highchair 74 or the like can be configured mount directly onto and be supported by the seat base 22 and frame 24. In an alternative embodiment, the seat base 22 can be configured so that it is readily removable from the highchair frame 24, and to be replaced by a different seat, such as a highchair seat. In the example of FIGS. 1-3, the seat base 22 and frame 24 can be utilized, without the seat back insert 50, as a youth chair for a larger toddler or young child not yet big enough to safely or comfortably sit in a standard adult chair.

Figure 4:
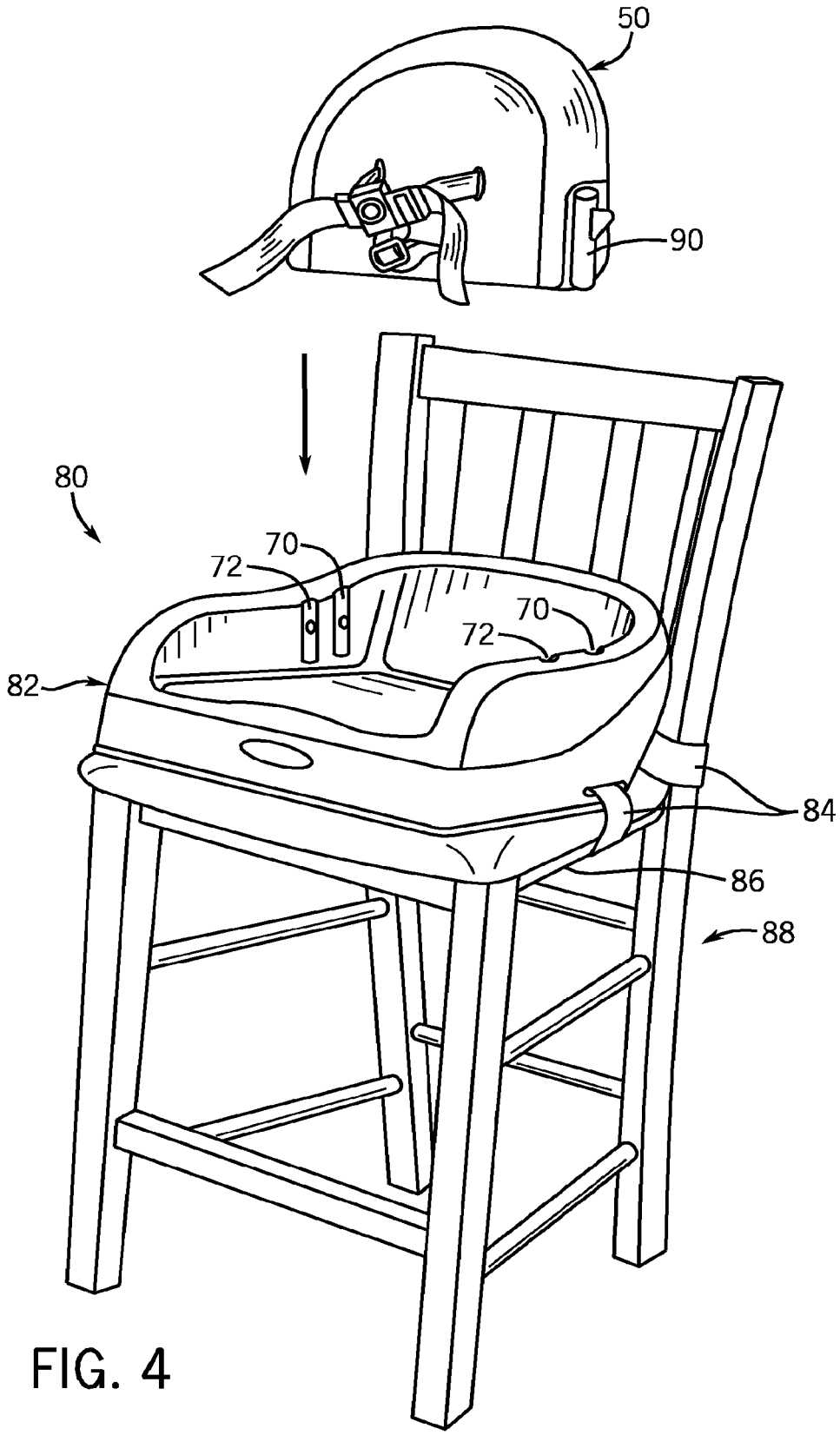
FIG. 4 shows another embodiment of a child seat in accordance with the teachings of the present invention.

FIG. 4 shows another example of a child seat 80 constructed in accordance with the teachings of the present invention. In this example, the child seat 80 has a seat base 82 that is substantially similar to the seat base 22 as previously described. However, the seat base 22 has a foot rest structure depending from the front edge 32 so that the child seat can be used as a highchair. In this alternate example, the footrest has been eliminated. Thus, the seat base 82 is representative of a more conventional booster seat, other than incorporating the adjustable seat back features of the invention. In this example, the seat base 82 also includes an attachment mechanism in the form of straps 86 to secure the base to a seat bottom 86 on a conventional chair 88 as is known in the art.

Figure 5:
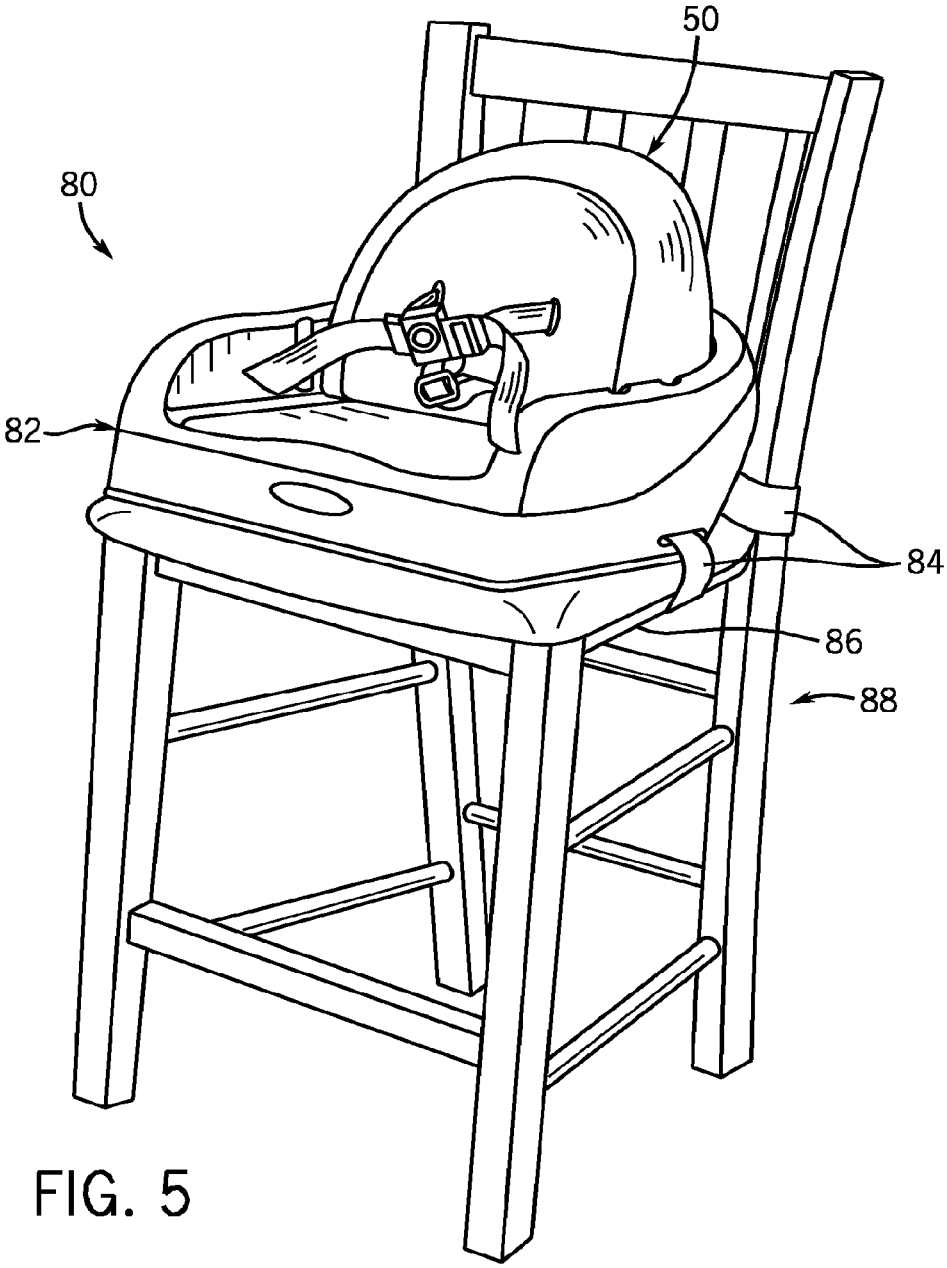
FIG. 5 shows the child seat in FIG. 4 with the seat back insert installed on the seat base of the child seat.
Figure 6:
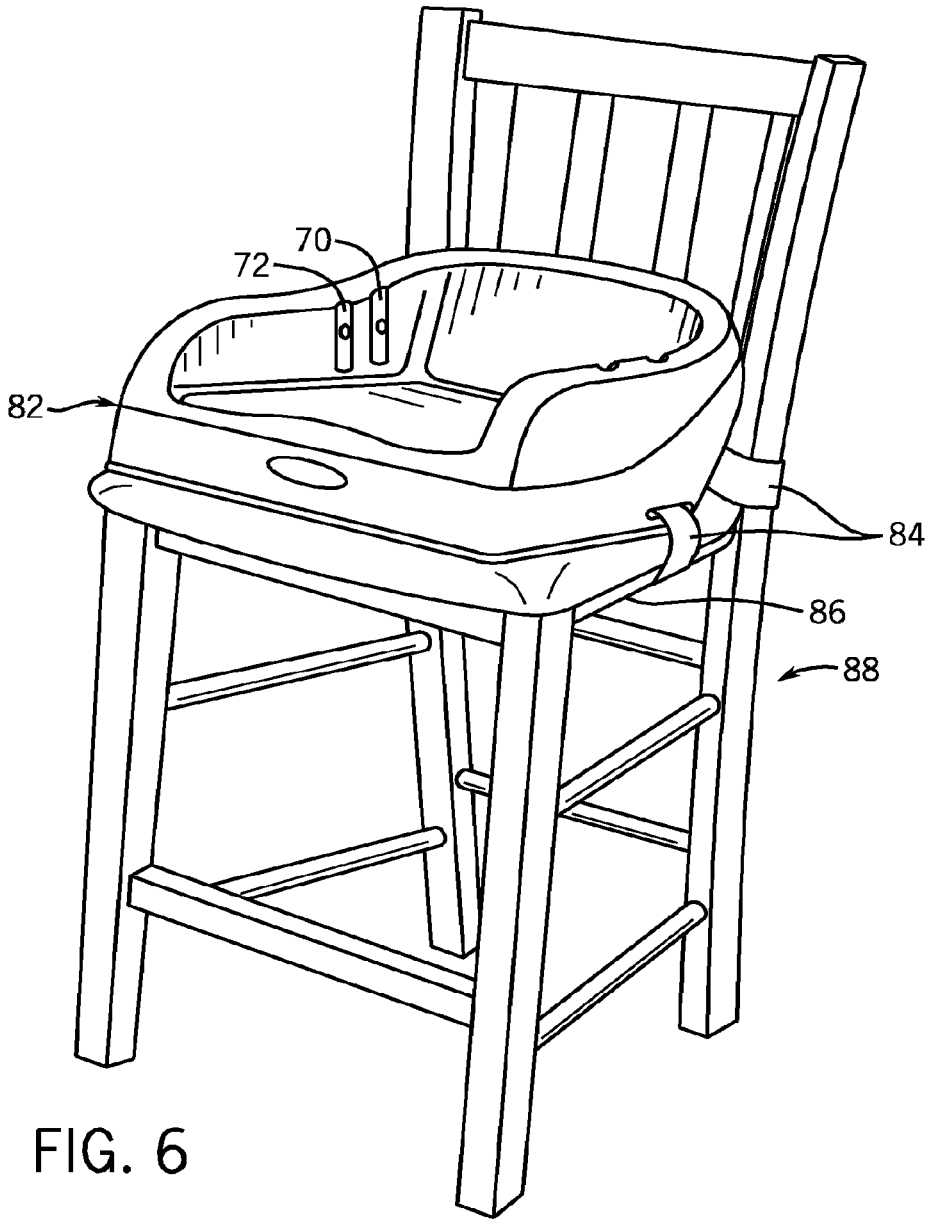
FIG. 6 shows the child seat in FIG. 4 in a booster seat configuration with the seat back insert removed from the seat base.

In this example, the child seat 80 employs the same seat back insert 50 and the same first and second pairs of channels 70 and 72 as previously described. FIG. 5 shows the seat back insert 50 mounted to the seat base 82 utilizing the first pair of channels 70 as previously described. As with the child seat 20 of the prior example, the child seat 80 can be utilized in three different adjusted seat back configurations. The seat back insert 50 can be removed entirely from the base 82 exposing the back wall surface 40 as the back support surface of the seat 80. In this configuration, shown in FIG. 6, the seat base 82 functions as a conventional booster seat for larger toddlers and small youths. The seat back insert 50 can also be installed on the seat base 82 utilizing either the channels 70 or 72 in the first inset position or the second insert position as previously described to deploy the back support surface 60 in two additional, optional positions. The desired distance of the back support surface 60 (or 40) from the front edge 32 of the seating surface 30 can thus be selected by a user from the three options.

In the above examples, a child seat system can be provided having both the seat 20, including the seat base 22 and frame 24, a separate booster seat base 82, and a universal seat back insert 50 for interchangeable use on either of the child seat bases. The seat back insert can be removed from the booster seat base 82 and installed on the highchair seat or youth chair seat base 22, and vice versa. In such an example, both the booster seat base 82 and the highchair or youth chair seat base 22 can be rendered adjustable to several different seat back or back support positions relative to the front edge of the corresponding seat. Such a child seat system would create a versatile seating and feeding chair system to accommodate many different sized children or a child as he or she grows from early infancy to toddler age.

In the examples depicted in FIGS. 1-6, each of the channels 70 and 72 can have a generally curved, U-shaped cross-section. Each of the side edges 56 on the seat back insert 50 has an elongate vertical protrusion 90. The protrusions 90 have a complimentary U-shaped cross-section to match that of the channels 70, 72. Each of the protrusions 90 can slide downward into a respective one of the selected pair of channels 70 or 72 when installing the seat back insert 50 on either of the seat bases 22 or 82. In one example, friction and/or tight part tolerance between the channels and protrusions can be the only means of retention for the seat back insert. Additional retention devices and methods can be employed as well, if desired.

Figure 7B:
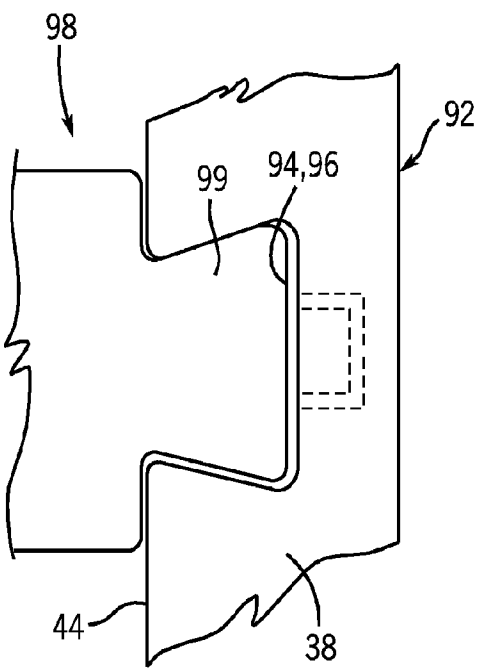
FIG. 7B shows a top view of a portion of the child seat shown in FIG. 7A.
Figure 7A:
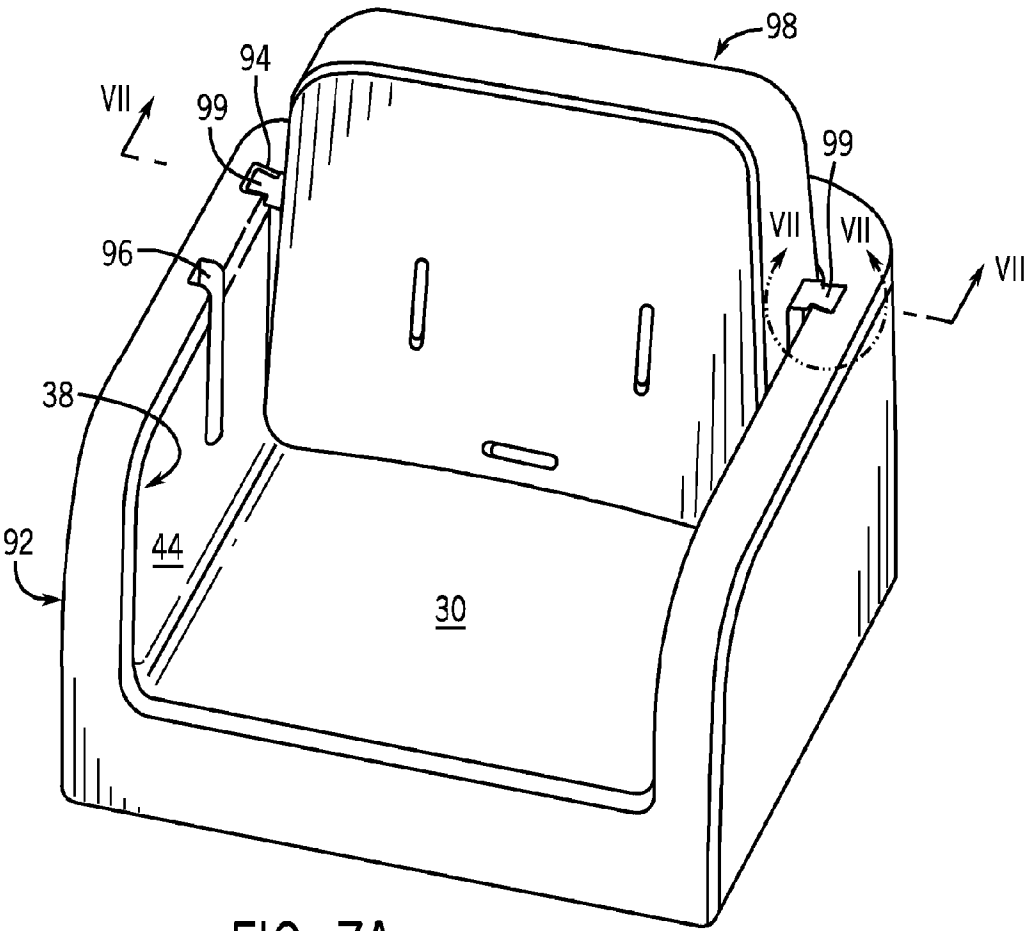
FIG. 7A shows another example of a child seat in accordance with the teachings of the present invention.

For example, the cross-section shape of the channels 70 and 72 and the protrusions 90 can vary within the spirit and scope of the present invention. To accomplish a more secure connection between the seat back insert 50 and the seat base 82, the channels can take on a different cross-section that helps to retain the seat back insert attached to the base. For example, an alternate seat base 92 is depicted in FIG. 7A. The seat base 92 has a first pair of channels 94 and a second pair of channels 96, again recessed into the side wall surfaces 44 of the side walls 38 and open into the top end 42. As shown in FIG. 7B, each of the channels 92 and 94 can have a dovetail shape and cross-section, being wider at the deepest part of the channel recess. An alternate example of a seat back insert 98 can include a dovetail-shaped protrusion 99 extending vertically along its side edges 56, replacing the U-shaped protrusions 90 in the prior examples. The complimentary dovetail configuration of the protrusions 99 and the channels 94 and 96, along with the size of, and the materials used to make, the two mating structures can create an interlock connection between the seat back insert 98 and the base 92 in this example.

And interlocking configuration, with or without interference and/or a friction fit, between the channels 94, 96 on the seat base 92 and the protrusions 99 on the seat back insert 98 can provide the sole means of retention. Optionally, the two components can connect or attach to one another as described above, i.e., using only rounded or square channels and like-shaped protrusions with no specific interlocking arrangement. A dimple and recess-type detent arrangement can be provided on mating surfaces of the channels and protrusions to assist in retaining the seat back insert attached to the seat base, if desired. In another example, the channels can instead be provided on the side edges of the seat back insert and the complementary protrusions can be provided on the seat base at located to permit attachment of the insert to the base. In another example, the channels and protrusions could be replaced by other alternate attachment structures that permit removal and replacement of the seat back insert. As will be evident to those having ordinary skill in the art, the configuration and construction of the seat bases and seat back inserts disclosed and described herein can vary within the spirit and scope of the present invention.

Figure 8:
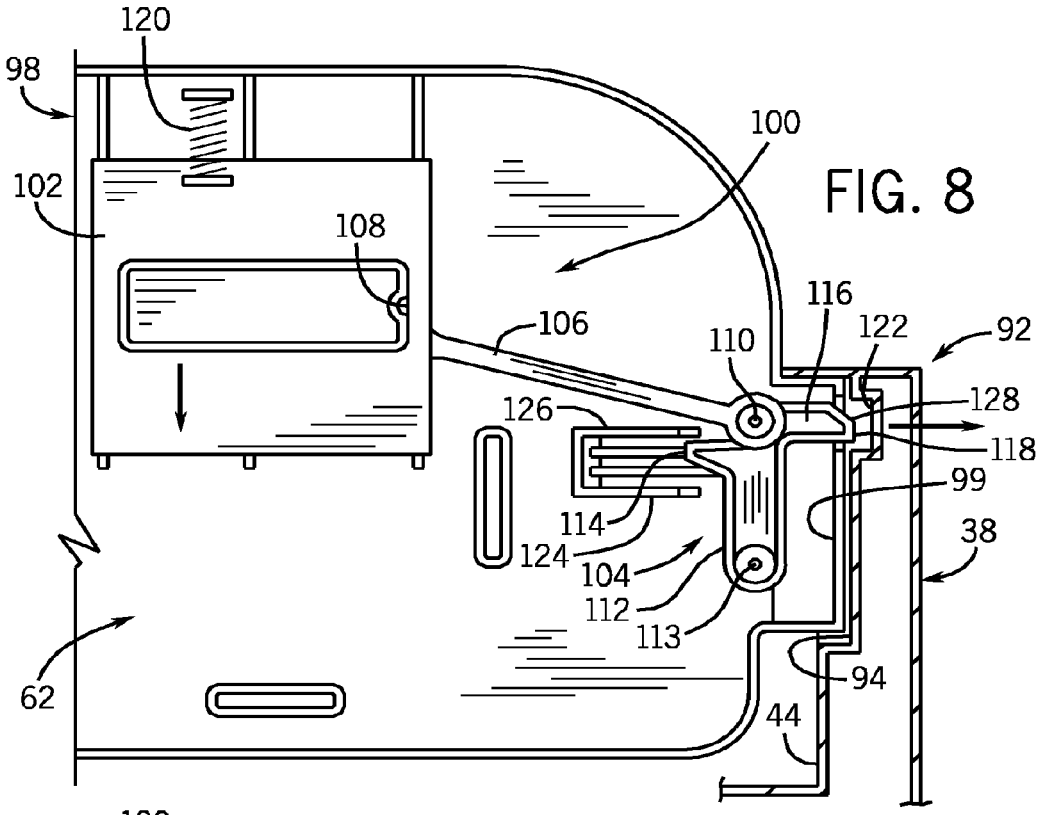
FIG. 8 shows a cutaway cross-section of a portion of the child seat taken along line VII-VII in FIG. 7A and with a seat latch mechanism in a latched configuration.
Figure 9:
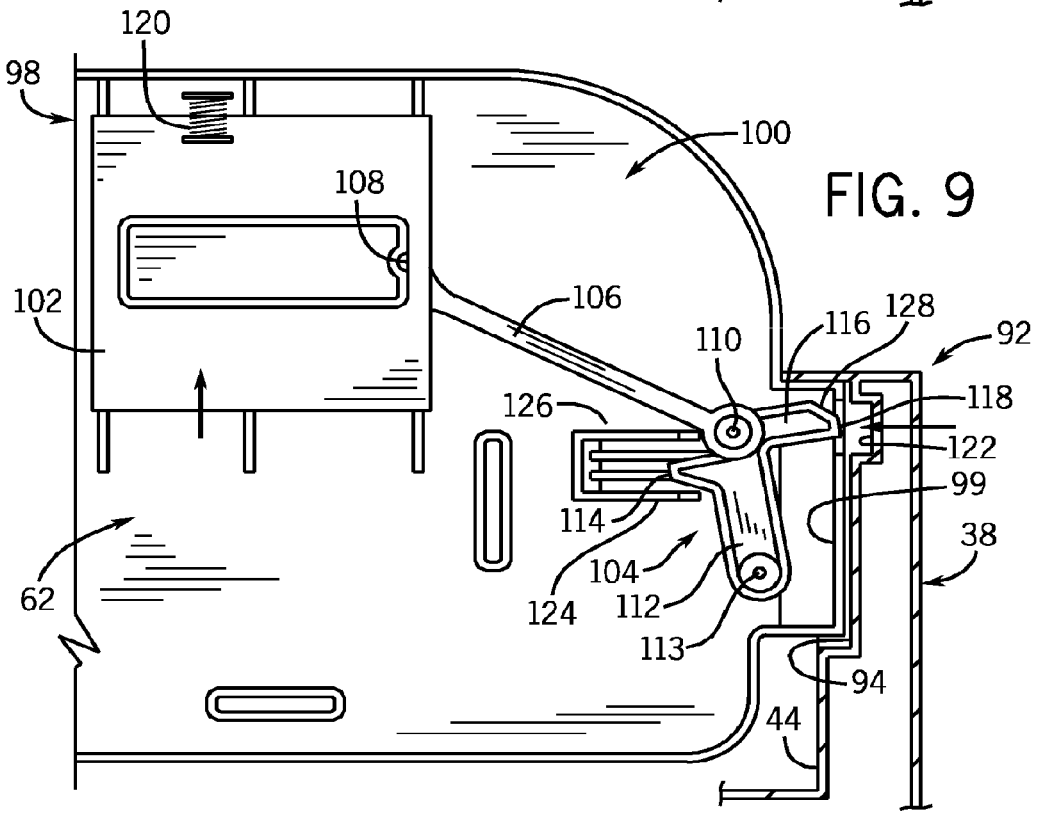
FIG. 9 shows the child seat portion in FIG. 8 but with the latching mechanism in a released condition.

In yet another example, a latch mechanism can be employed to assist in further retaining the seat back insert attached to the seat base. FIGS. 8 and 9 illustrate various details of one example of such a latch mechanism 100. In these figures, the rear side 62 of the seat back insert 98 is removed to illustrate the components and function of the latch mechanism 100. In this example, the mechanism 100 generally has an actuator 102 with a grip portion 103. At least the grip portion 103 would be exposed on the rear side 62 of the insert, while the reminder of the actuator 102 and latch mechanism components would or could be hidden within the body of the insert 98.

In this example, the latch mechanism 100 has a pair of pivotable latches 104; one positioned on each side edge 56 of the seat back insert 98, and a pair of links 106, one each connecting one of the latches 104 to a corresponding side of the actuator. Each link 106 has one end pivotally coupled at a first pivot 108 to its respective side of the actuator 102. An opposite end of each link 106 is pivotally connected at a second pivot 110 to the respective latch 104. Each latch 104 in this example is generally L-shaped (or T-shaped) and has a leg 112 with the second pivot 110 positioned at one end of the leg. An opposite end of the leg 112 is pivotally connected at a third, fixed pivot 113 on the seat back insert, about which the latch 104 can pivot. Each latch also has a stop tab 114 projecting from the leg 112 near the pivot 110 and inward in a direction toward the other latch. Each latch 104 further has a finger or catch 116 that projects from the leg 112 in a direction generally opposite the stop tab 114 and also near the second pivot 110. Each catch 116 extends outward toward the respective side edge 56 and through an opening in the corresponding elongate protrusion 99. An end of each catch 116 projects from the corresponding side edge 56 on the seat back insert 98.

Figure 10:
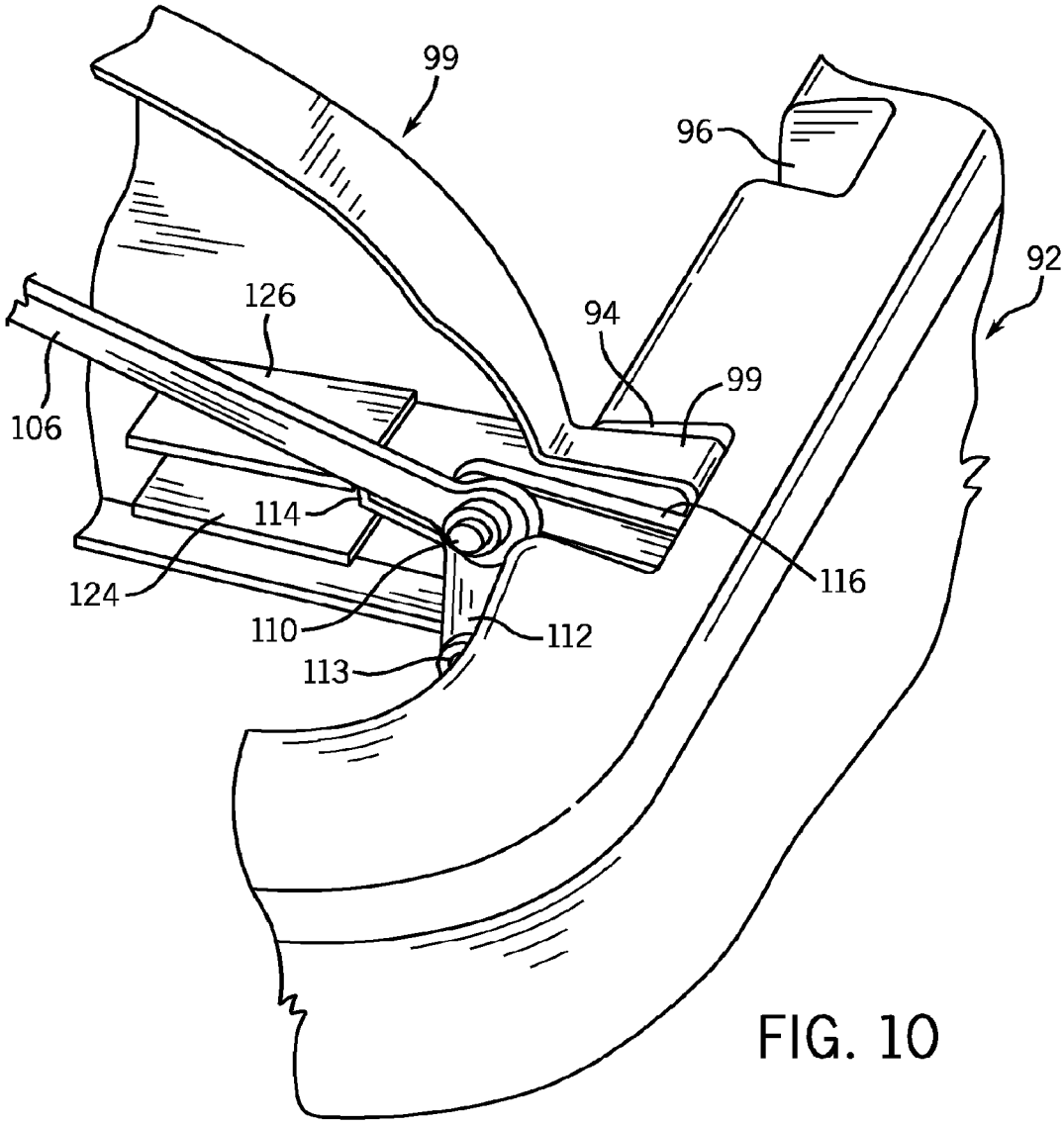
FIG. 10 shows a rear perspective, partly cut away view of the child seat portion shown in FIG. 8.

A spring 120 can be provided to bias the actuator 102 downward and the latch mechanism 100 to a latched condition as shown in FIG. 8. The spring can be provided on virtually any part of the latch mechanism 100. In this example, each of the channels 94 and 96, 94 being depicted in FIGS. 8 and 9, has a catch receiver 122 recessed further inward into the sidewall 38. As shown in FIG. 8, the exposed end of each catch 116 is received in the receiver 122 in the latched condition. In this condition, the seatback insert 98 would be prevented by contact between the catch 116 and a surface of the latch receiver 122 from being drawn upward out of the channel 92, unless the actuator is moved to a released condition as depicted in FIG. 9. When the actuator 102 is pulled upward in this example, the link 106 causes the latch 104 to pivot about the fixed pivot 113. This pivoting movement of the latch 104 withdraws the catch 116 from the latch receiver 122 providing clearance for vertical or upward sliding of the seat back insert 98 from the channels 92. The stop tab 114 can be utilized to bear against a stop surface 124 to limit the inward pivot of the latch 104. In addition, or alternatively, the stop tab 114 can be utilized in conjunction with another stop surface 126 on the seat back insert 98 to limit outward rotation or movement of the latch 104. This function can prevent the seat back insert 98 from being removed with the latch mechanism in the latched condition as shown in FIG. 8. A perspective view is shown in FIG. 10 of a portion of the latch mechanism with the seat back insert 98 installed on the seat base 92.

A chamfered or wedge surface 128 is provided on the top corner of each catch 116, which may allow the catch to clear the recess or receiver 122 when released. The size of the receiver and catch, as well as the tolerance or play in the various parts can be design to allow some vertical movement of the seat back insert when attached in order to allow latching and releasing of the latch mechanism. The catches can be automatically pivoted upward against the spring bias by contact with the channel and side wall surfaces when the insert is installed. The spring bias can then fire the catches into the receivers to secure the seat back insert in place.

Figure 11:
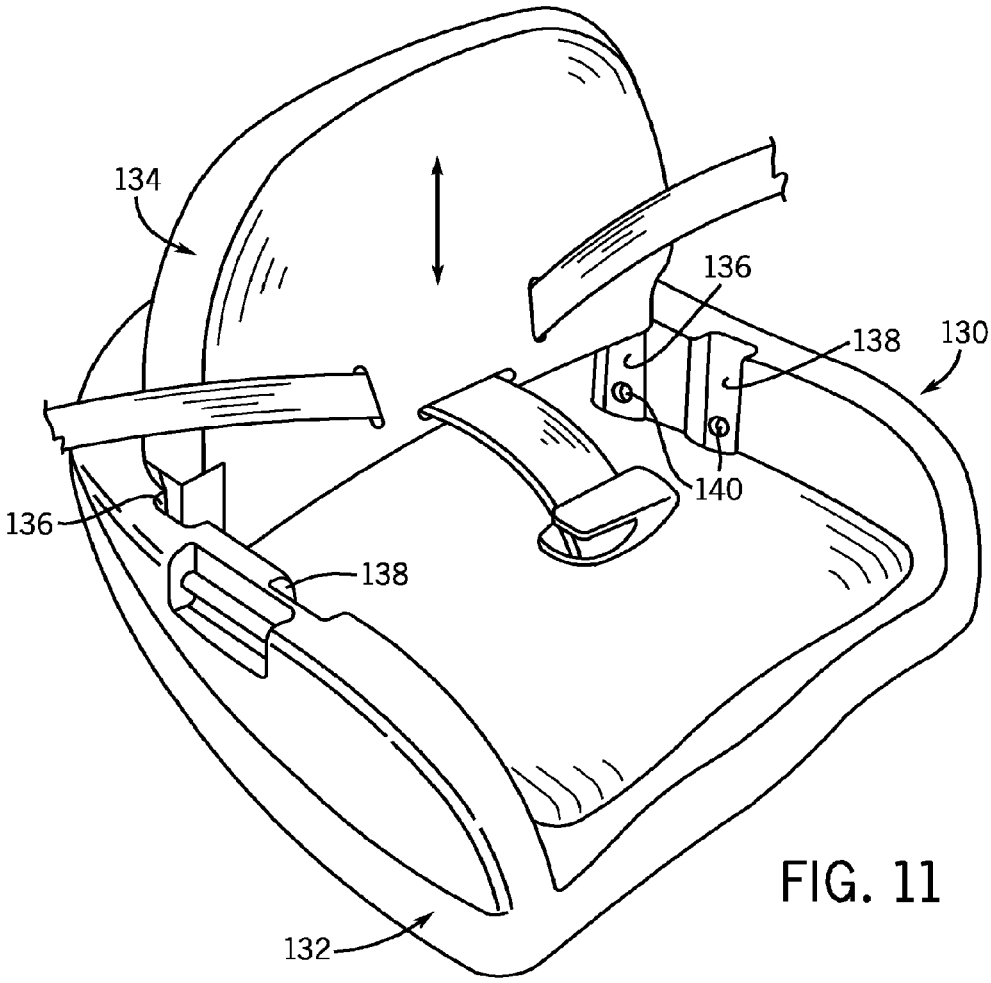
FIG. 11 shows another example of a child seat in accordance with the teachings of the present invention and with a seat back insert partly installed on the seat base.

FIG. 11 illustrates an alternate example of a child seat 130 in accordance with the teachings of the present invention. In this example, the child seat has a seat base 132 that is similar in construction to the previously described seat bases. The child seat 130 also has a seat back insert 134 that is similar in construction to those previously described. However, in this example, the seat base 132 has a first pair of channels 136 and a second pair of channels 138 that differ slightly from those in the prior examples. In this example, each of the channels 136 and 138 has a blind hole or recess 140 positioned at or near the bottom end of the channel. In the prior examples, the catch receiver 122 was positioned near a top end of the channel.

Figure 12A:
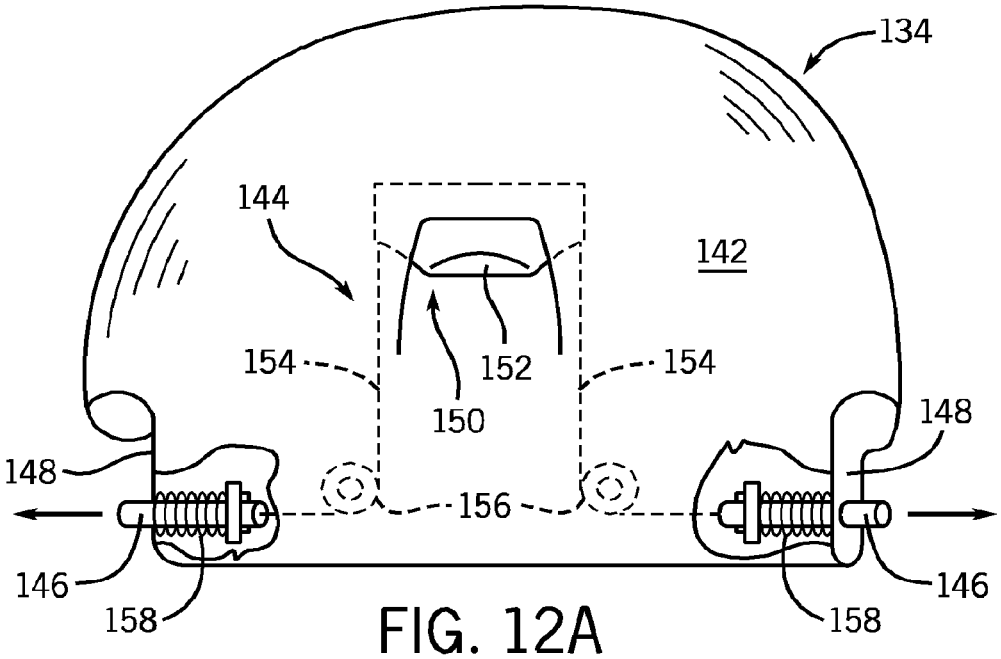
FIGS. 12A and 12B show the seat back insert of FIG. 11 with a latching mechanism in a latched position and a released position, respectively.
Figure 12B:
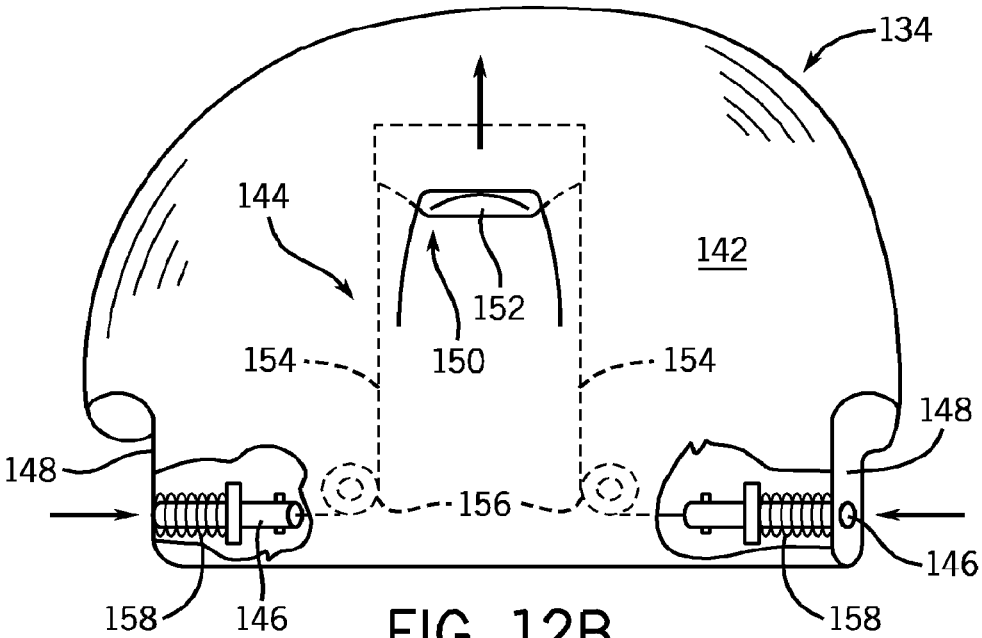

FIGS. 12A and 12B illustrate a back or rear side 142 of the seat back insert 134 in this example, which has an alternate example of a latch mechanism 144. In this example, the latch mechanism 144 has a pair of retractable slogs or catches 146 projecting from opposite side edges 148 of the seat back insert 134. Also in this example, the side edges 148 and channels 136, 138 are configured so that the seat back insert 134 slides directly into the selected pair of channels, instead of including separate protrusions on the side edges. The latch mechanism 144 in this example also employs an actuator or handle 150 with a grip portion 152 exposed on the rear side 142. A cable or cables 154 can be coupled to the actuator 150 and the actuator can be drawn or pulled upward. This movement of the actuator moves the latch mechanism from a latched condition depicted in FIG. 12A to a release condition depicted in FIG. 12B. The cables are routed around pulleys 154 and are connected to the slugs 146. Each of the slugs 146 is biased by a spring 158 toward the latched condition protruding from the side edges 148 of the seat back insert 134. Moving the actuator 150 upward pulls the cables 154, which in turn pull the slugs 146 inward against the spring bias to the released condition. When the seat back insert 134 is slid downward into a selected pair of the channels 136 or 138, the slugs 146 will fire into the blind holes 140 to retain the seat back insert 134 attached to the seat base 132.

Figure 13A:
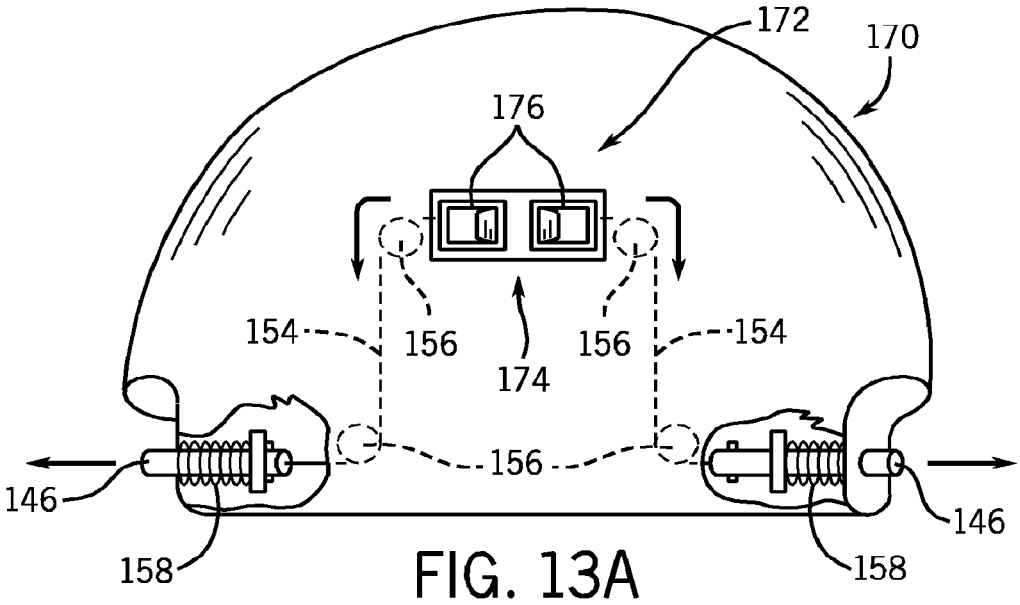
FIGS. 13A and 13B show another example of a seat back insert for the seat base depicted in FIG. 11 and in a latched condition (FIG. 13A) and a released condition (FIG. 13B).
Figure 13B:
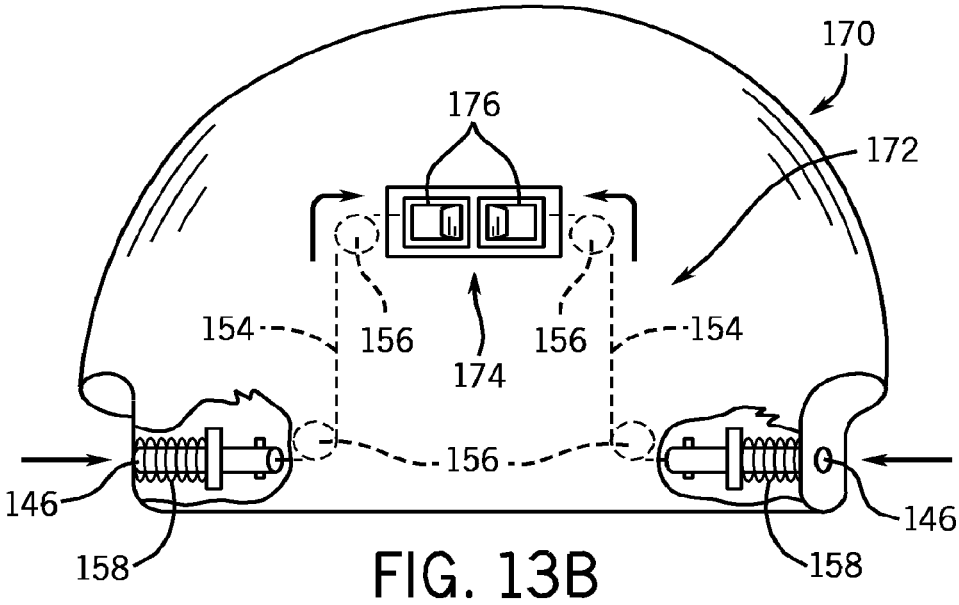

FIGS. 13A and 13B illustrate another example of a seat back insert 170 configured very similar to seat back insert 134 in the prior example. In this example, a latch mechanism 172 again employs slugs or catches 146 projecting from side edges 148 of the seat back insert 170. The slugs 146 are again biased by springs 158 to the latched condition and are connected to cables 154, which are routed around pulleys 156. However, in this example, an actuator 174 requires an inward, dual squeezing motion to actuate the slugs. The actuator 174 has a pair of spaced apart actuator components 176 that can be gripped and squeezed or pulled toward one another from a latched condition depicted in FIG. 13A to a released condition depicted in FIG. 13B.

Figure 14B:
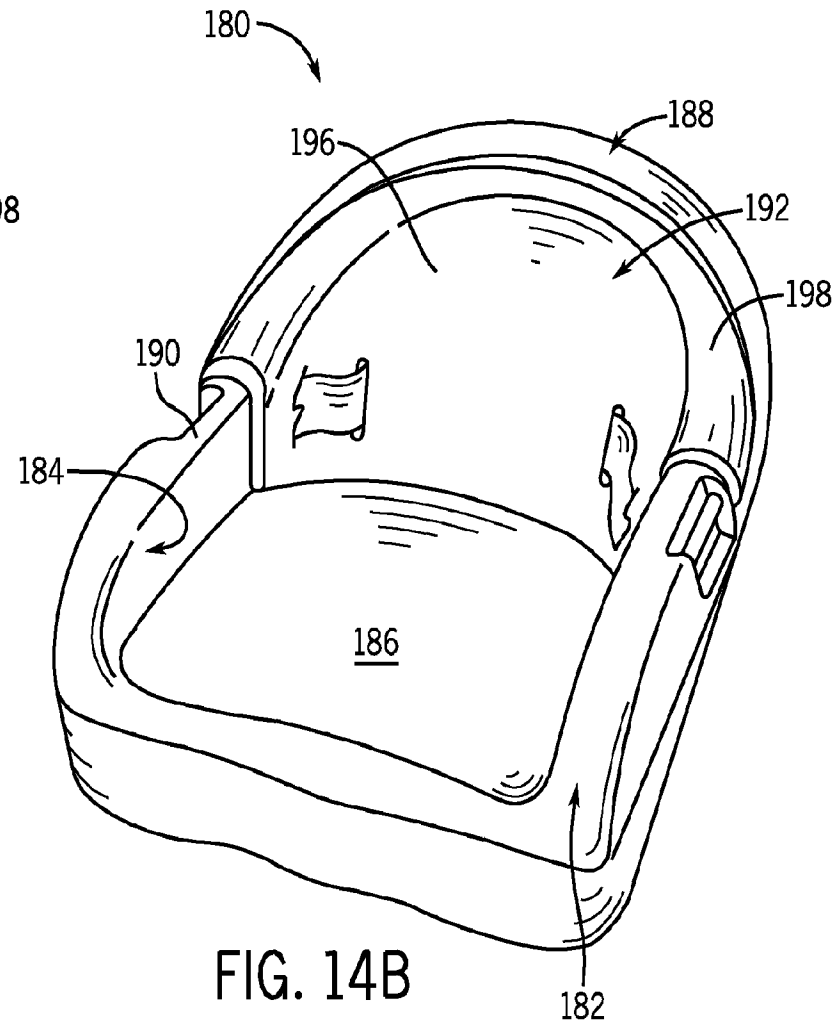
FIGS. 14A and 14B show another example of a child seat in accordance with the teachings of the present invention and with a seat back insert removed from (FIG. 14A) and installed on (FIG. 14B) the set base.
Figure 14A:
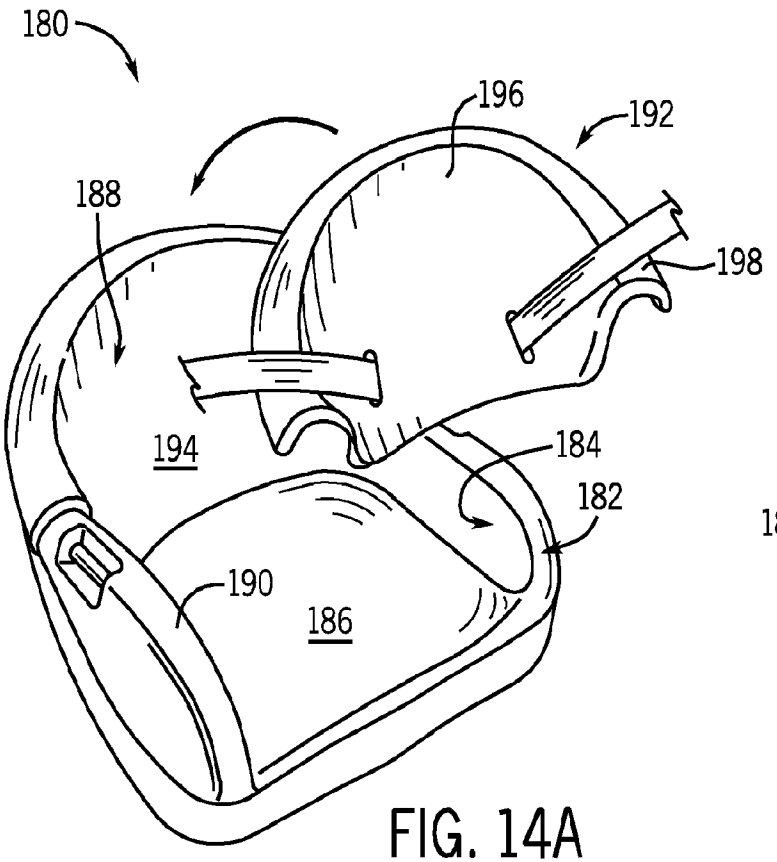

FIGS. 14A and 14B illustrate another example of a child seat 180 in accordance with the teachings of the present invention. In this example, seat base 182 is constructed similarly to the previously described seat bases, except that no channels are provided on the side wall. In this example, the seat base 182 generally has a pair of opposed side walls 184 projecting up from a seating surface 186. The seat base 182 also has a back wall 188 integrally formed with the side walls 184 to form a continuous rim wall. The rim wall has a top edge or end 190 running along the side walls 184 and the back wall 188. In this example, a seat back insert 192 is configured to snap onto the seat base 182 to alter or change the location of the back support surface. As shown in FIG. 14A, the seat base 182, without the seat back insert 192 installed, has a back wall surface 194 that would be exposed to define the back support surface of the child seat. The seat back insert 192 in this example has a back support 196 and a partial perimeter lip 198 on a top edge of the insert. The lip 198 has an inverted or downward facing U-shape configured to be slipped over the top end 190 of the side wall 184 and back wall 188 on the seat base 182. The seat back insert 192 can be configured so that the back support 196 creates a back support surface that is spaced forward from the back wall surface 194, thus adjusting the position of the back support surface. As will be evident to those having ordinary skill in the art, the configuration and construction of the side walls, back wall, and seat back insert can vary in configuration and construction from the example shown. Particularly, the mechanism or means by which the seat back insert 192 snaps onto or otherwise attach to the seat base 182 can vary.

Figure 15:
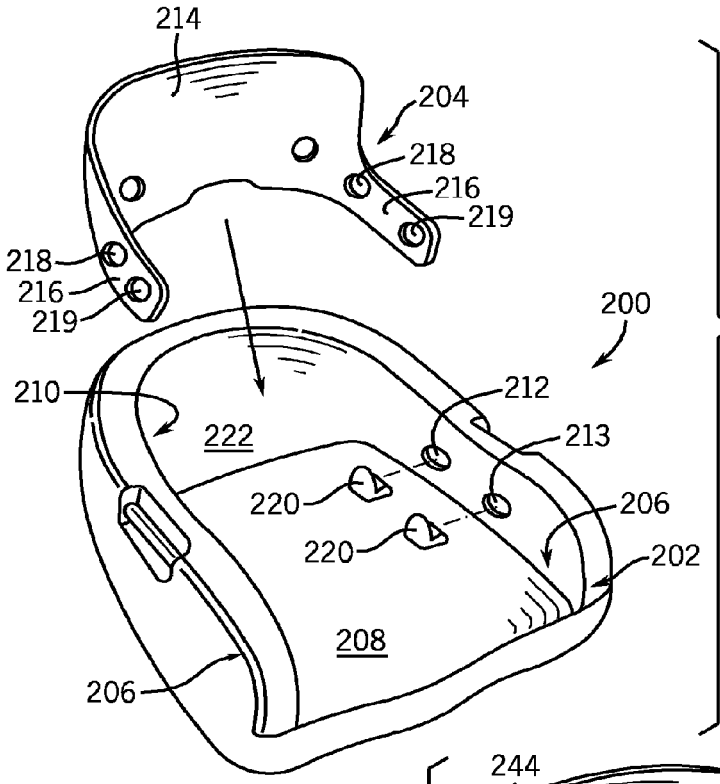
FIG. 15 shows an exploded view of another example of a child seat in accordance with the teachings of the present invention.

FIG. 15 illustrates yet another example of a child seat 200 in accordance with the teachings of the present invention. In this example, the child seat 200 has a seat base 202 and a removable and replaceable seat back insert 204. The seat base 202 again has a pair of opposed side walls 206 extending up from a seating surface 208 of the seat base. The side walls 206 continue into an integral back wall 210. In this example, first and second pairs of blind holes or receptacles 212 and 213 are provided, one of each pair in each of the side walls 206. The seat back insert 204 in this example has a back support section 214 and a pair of extensions 216 projecting forward, one from each side of the back support section 214. The extensions 216 have first and second pairs of openings 218 and 219 formed therethrough. The openings 218, 219 are spaced so as to align with the first and second pairs of holes 212 and 213. A plurality of fasteners 220 are provided and configured to pass through the openings 218, 219 in the extensions 216 of the seat back insert 204 and into the holes 212, 213 to retain the seat back insert 204 in place. The type of fastening mechanism for the fasteners 220 can vary and include, for example, threaded connections, snap connections, twist-and-lock connections, or the like.

With a fastener 220 secured through each of the openings 218, 219 in each of the holes 212, 213, the position of the back support section 214 can be such that it is spaced forward from the back wall 210. Attaching the insert 204 to the seat base 202 can thus adjust the position of the back support surface of the child seat. With the insert attached, the back support surface is defined by the location of the back support section 214. With the insert 204 removed from the seat base 202, the back support surface is defined by the exposed back wall surface 222 of the back wall 210. In another example, the openings 219 and holes 212 could go unused and the openings 218 can be aligned with the holes 213 to attach the insert 204. This would move the seat back insert 204 closer to the front edge of the seating surface 208. Alternatively, the openings 218 and holes 213 could go unused and the openings 219 can be aligned with the holes 212 to attach the insert 204. This would move the seat back insert 204 further from the front edge of the seating surface 208. Using the openings and holes in such a manner allows for three adjusted seat back insert positions on the seat base 202 in this example. In this example, only a single pair of openings and holes could be provided on the child seat 200. Alternatively, more than two holes could be provided in the side walls and/or more than two openings could be provided in the extensions to create even more selectable adjustment positions for the seat back insert.

Figure 16:
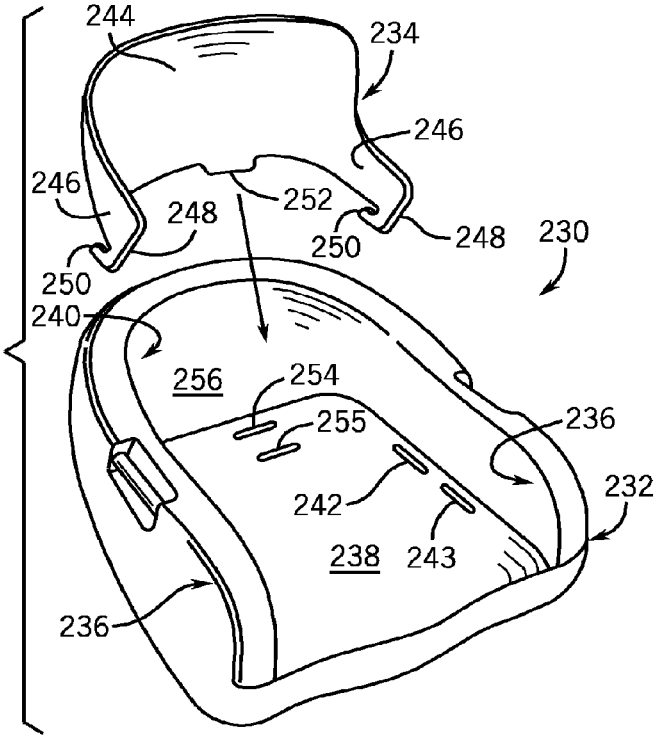
FIG. 16 shows an exploded view of another example of a child seat in accordance with the teachings of the present invention.

FIG. 16 shows another example of a child seat 230 in accordance with the teachings of the present invention. In this example, the child seat 230 has a seat base 232 and a removable and replaceable seat back insert 234. The seat base 232 again has a pair of opposed side walls 236 extending up from a seating surface 238 of the seat base. The side walls 236 continue into an integral back wall 240. In this example, first and second pairs of slots 242 and 243 are provided in the seating surface 238, one of each slot pair closely adjacent each of the side walls 236. The seat back insert 234 in this example has a back support section 244 and a pair of extensions 246 projecting forward, one from each side of the back support section 244. A hook 248 projects down from a bottom edge near the front end of each extension 246. A catch portion 250 extends rearward from each hook 248 in this example below the bottom edge of the extension. A tab 252 or hook projects down from the bottom edge of the back support section 244 and corresponding selectable slots 254,255 are positioned in the seating surface 238 adjacent the back wall 240.

The seat back insert 234 is attached in this example by selecting an aligned pair of the slots 242 or 243 and by hooking the catches 250 of the hooks 248 into the selected slots. The tab can then be inserted into the corresponding tab slot 254, 255, which can have a snap or detent feature if desired. Again, the number of optional slot pairs can vary from the two pairs shown, as desired for a particular seat application and can include only a single slot pair or three or more slot pairs. In addition, the hooks 248 can be replaced by other types of hooks, snaps, fasteners, and the like.

With the hooks 248 and tab 252 secured in the respective selected slots, the position of the back support section 244 can be such that it is spaced forward from the back wall 240 as previously described herein to adjust r alter the position of the back support surface on the child seat 230. With the insert 234 attached, the back support surface is defined by the location of the back support section 244. With the insert 234 removed from the seat base 232, the back support surface is defined by the exposed back wall surface 256 of the back wall 240.

As will be evident to those having ordinary skill in the art, the configuration of the slots, openings, receivers, channels, holes, connectors, fasteners, hooks, pins, latches, catches, actuators, and the like can vary from the examples shown. The configuration and construction of the various seats and seat backs can also vary from the examples shown herein and yet function as intended. The various alternate configurations and arrangements for each example described herein are equally applicable to the other examples, where feasible.

By creating a separate seat back insert that can be mounted to a booster seat base, a youth chair or highchair seat base, or both, a versatile, modular child seat and/or seating system is created to accommodate a wide range of child seating needs. In each example, at least two different seat back or back support positions are optionally available on a given child seat. In many of the examples disclosed herein, there are more than two optional positions available on the seat. The disclosed child seats can be manufactured, provided, and/or utilized without a corresponding highchair or youth chair. Also, the highchairs or youth chairs can also be manufactured, provided, and/or utilized without a corresponding booster seat base, if desired. Providing both yields a seating system that can grow as a child grows. The harnesses may be, but need not be, removable from the disclosed seat back inserts. However, the harnesses can be transferred from booster seat base to youth chair or highchair seat base by easily removing the seat back portion. The harnesses can also be easily removed with the seat back insert to adjust a child seat for a larger child that would not require a harness.

On many of the example, the seat back insert can be repositioned to adjust the seat for different sized children. The removable seat back insert can be provided, as disclosed herein, with a latch mechanism to secure the seat back insert on the seat base. Also, the latch mechanisms can employ a one-hand actuator to adjust the insert position and to remove the seat back insert, as desired.

Although certain child seats have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A child seat comprising:

a seat base having an upward facing seating surface, a front edge, and a back end opposite the front edge;

a back support surface that is generally upstanding and inclined relative to the seating surface; and a seat bight formed at the juncture between the seating surface and the back support surface;

a first pair of channels formed one each on opposite sides of the seat base;

a seat back insert configured to removably attach at the first pair of channels to the seat base at a first insert position defining the first bight position, the seat back insert having opposed side edges and a surface defining the back support surface in the first insert position;

a retractable catch projecting from each opposed side edge of the seat back insert; and a catch receiver provided in each of the first pair of channels and configured to receive a respective one of the catches when the seat back insert is attached to the seat base, wherein the seat bight is adjustable between a first bight position spaced a first distance from the front edge of the seat base and a second bight position spaced a second distance from the front edge of the seat base, the second distance being less than the first distance.

2. A child seat according to claim 1, wherein the seat back insert is removable from and replaceable on the seat base to adjust the distance of the seat bight relative to the front edge, and wherein the seat back insert defines the back support surface for the second bight position.

3. A child seat according to claim 1, wherein the seat back insert is replaceable on the seat base in the first insert position and a second insert position and defines the back support surface for the first bight position in the first insert position and defines the back support surface for the second bight position in the second insert position.

4. A child seat according to claim 1, wherein the seat base further comprises:

a back wall extending up from the seat base near the back end, the back wall having a wall surface facing the seating surface and the front edge.

5. A child seat according to claim 4, wherein the seat back insert is removable from and replaceable on the seat base, and wherein the seat back insert defines the back support surface in the first bight position and the second bight position and the wall surface of the back wall defines a third bight position.

6. A child seat according to claim 4, wherein the seat back insert is removable from and replaceable on the seat base in the first insert position and the second insert position, wherein the seat back insert in the first insert position defines the back support surface in the first bight position and in the second insert position defines the back support surface in the second bight position, and wherein the wall surface of the back wall defines the back support surface in a third bight position when the seat back insert is removed.

7. A child seat according to claim 1, further comprising:

a second pair of channels formed one each on opposite sides of the seat base and spaced from the first pair of channels, wherein the seat back insert can be removably attached at the second pair of channels to the seat base at a second insert position defining the second bight position and the back support surface in the second insert position.

8. A child seat according to claim 1, further comprising:

a release handle on the seat back insert actuable to retract the catches from the catch receivers to remove the seat back insert from the seat base.

9. A child seat according to claim 1, further comprising:

a pair of opposed side walls extending up from the seat base, one on each opposed side of the seating surface, each of the pair of side walls having a top end and a side wall surface on an inner side facing the seating surface, wherein the first pair of channels are aligned with and opposite one another across the seat base and each is open into the top end and is recessed into the side wall surface of a corresponding one of the pair of side walls, and wherein the seat back insert is configured to slide downwardly into the first pair of channels to attach the seat back insert to the seat base at the first insert position defining the first bight position.

10. A child seat according to claim 1, wherein the seat base is carried on a highchair frame and is configured so that a highchair seat can be mounted and supported on the seat base.

11. A child seat according to claim 1, wherein the seat base is a booster seat configured to rest on a seat of a chair.

12. A child seat according to claim 11, wherein the booster seat has attachment devices for securing the booster seat to seat of a chair.

13. A child seat comprising:

a seat base having a seating surface, a front edge, opposed sides, and a back end opposite the front edge;

a seat back insert removably attachable to the seat base above the seating surface, the seat back insert having opposed side edges and a back support surface facing toward the front edge of the seat base, wherein the seat back insert is attachable to the seat base in at least a first insert position with the back support surface spaced a first distance from the front edge and a second insert position with the back support surface spaced a second distance from the front edge less than the first distance;

a retractable catch projecting from each of the opposed side edges of the seat back insert;

a first receiver on each of the opposed sides of the seat base configured to receive a respective one of the catches when the seat back insert is attached at the first insert position to the seat base; and a second receiver on each of the opposed sides of the seat base configured to receive a respective one of the catches when the seat back insert is attached at the second insert position to the seat base.

14. A child seat according to claim 13, further comprising:

a side wall on each opposed side and extending up from the seat base, each side wall having a top end and a side wall surface on an inner side facing the seating surface;

a first pair of channels aligned with and opposite one another across the seat base, one being formed in each of the side walls, the seat back insert being slid into the first pair of channels when attached to the seat base at the first insert position; and a second pair of channels spaced from the first pair of channels in the side walls and aligned with and opposite one another across the seat base, the seat back insert being slid into the second pair of channels when attached to the seat base at the second insert position.

15. A child seat according to claim 14, wherein each channel of the first and second pair of channels is open into the top end and recessed into the side wall surface of the respective side wall.

16. A child seat according to claim 13, further comprising:

a release actuator on the seat back insert arranged to retract the catches when actuated.

17. A child seat comprising:

a seat base having a seating surface, a front edge, and a back end opposite the front edge;

a back wall extending up from the seat base near the back end and having a wall surface facing the seating surface and the front edge;

a seat back insert removably attachable to the seat base above the seating surface, the seat back insert having a back support surface that is positioned forward of and closer to the front edge than the wall surface of the back wall when attached to the seat base;

a retractable catch projecting from each of opposed side edges of the seat back insert;

a first receiver on each of opposed sides of the seat base configured to receive a respective one of the catches when the seat back insert is attached at a first insert position to the seat base; and a second receiver on each of the opposed sides of the seat base configured to receive a respective one of the catches when the seat back insert is attached at a second insert position to the seat base, wherein, when the seat back insert is removed from the seat base, the wall surface of the back wall is exposed to perform as an alternate back support surface.

18. A child seat according to claim 1, further comprising a latch mechanism at least partially disposed in the seat back insert, the latch mechanism including:

an actuator;

links each having one end pivotally coupled to the actuator; and pivotable latches pivotally coupled to the seat back insert at fixed pivots, each of the links having another end pivotally coupled to a corresponding one of the pivotable latches, the pivotable latches including the retractable catches, wherein the links are operable to cause the pivotable latches to pivot about the fixed pivots when the actuator is moved in a direction.

19. A child seat according to claim 18, wherein the links are operable to cause the retractable catches to withdraw from the catch receivers when the actuator is moved in a first direction and the seat back insert is attached to the seat base, and wherein the links are operable to cause the retractable catches to move into the catch receivers when the actuator is moved in a second direction and the seat back insert is attached to the seat base.

20. A child seat according to claim 1, further comprising a latch mechanism at least partially disposed in the seat back insert, the latch mechanism including:

an actuator;

cables each having one end connected to the actuator; and slugs that are spring biased toward a latched condition protruding from the opposed side edges of the seat back insert, each of the cables having another end connected to a corresponding one of the slugs, the slugs being the retractable catches, wherein the cables are operable to cause the slugs to retract into a released position when the actuator is moved in a direction.

* * * * *